US010760246B2

(12) United States Patent
Hijikata et al.

(10) Patent No.: US 10,760,246 B2
(45) Date of Patent: Sep. 1, 2020

(54) WORK MACHINE

(71) Applicant: Hitachi Construction Machinery Co., Ltd., Taito-ku, Tokyo (JP)

(72) Inventors: Seiji Hijikata, Tsukuba (JP); Kouji Ishikawa, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/499,921

(22) PCT Filed: Mar. 8, 2018

(86) PCT No.: PCT/JP2018/009049
§ 371 (c)(1),
(2) Date: Oct. 1, 2019

(87) PCT Pub. No.: WO2019/171547
PCT Pub. Date: Sep. 12, 2019

(65) Prior Publication Data

US 2020/0056349 A1 Feb. 20, 2020

(51) Int. Cl.
*E02F 9/22* (2006.01)
*F15B 21/14* (2006.01)

(52) U.S. Cl.
CPC ..... *E02F 9/2221* (2013.01); *E02F 9/2271* (2013.01); *E02F 9/2292* (2013.01); *E02F 9/2296* (2013.01); *F15B 21/14* (2013.01)

(58) Field of Classification Search
CPC ..... F15B 21/14; E02F 9/2221; E02F 9/2271; E02F 9/2292; E02F 9/2296; E02F 9/22
See application file for complete search history.

(56) References Cited

U.S. PATENT DOCUMENTS 6,922,989 B2 * 8/2005 Nagura ..... F15B 1/024 60/414
9,200,430 B2 * 12/2015 Kawasaki ..... E02F 9/2217
(Continued)

FOREIGN PATENT DOCUMENTS

JP 2014-37861 A 2/2014
WO WO 2015/173963 A1 11/2015
WO WO 2017/056200 A1 4/2017

OTHER PUBLICATIONS

International Search Report (PCT/ISA/210) issued in PCT Application No. PCT/JP2018/009049 dated May 29, 2018 with English translation (three (3) pages).
(Continued)

*Primary Examiner* — Thomas E Lazo
(74) *Attorney, Agent, or Firm* — Crowell & Moring LLP

(57) ABSTRACT

Provided is a work machine capable of regenerating a return hydraulic fluid from a hydraulic actuator while preventing a drag loss of a regeneration hydraulic motor and a hydraulic pump from increasing and preventing the regeneration efficiency of the regeneration hydraulic motor from decreasing. A controller 100 computes a required regeneration hydraulic motor revolution speed from a displacement of a regeneration hydraulic motor 13 and a regeneration flow rate of the regeneration hydraulic motor, computes a required first hydraulic pump revolution speed from a displacement of a first hydraulic pump 15 and a target assist flow rate of the first hydraulic pump, and selects a greater one of the required regeneration hydraulic motor revolution speed and the required first hydraulic pump revolution speed as a target revolution speed of an electric motor 14.

5 Claims, 5 Drawing Sheets

(56) References Cited

U.S. PATENT DOCUMENTS

| | | | | |
|---|---|---|---|---|
| 9,803,339 | B2 * | 10/2017 | Nanjo | E02F 9/226 |
| 2015/0176609 | A1 | 6/2015 | Kawasaki et al. | |
| 2017/0009428 | A1 * | 1/2017 | Hijikata | F15B 13/06 |
| 2018/0038333 | A1 * | 2/2018 | Ahn | F15B 1/033 |
| 2018/0051720 | A1 | 2/2018 | Hijikata et al. | |

OTHER PUBLICATIONS

Japanese-language Written Opinion (PCT/ISA/237) issued in PCT Application No. PCT/JP2018/009049 dated May 29, 2018 (three (3) pages).

* cited by examiner 4
4A
41
141
44
144
40
140
120
REQUIRED PUMP FLOW RATE SIGNAL
102
FUNCTION GENERATION SECTION
101
102A
104
104A
105
105A
107
108
108A
109
109A
111
103
103A
114
MINIMUM FLOW RATE COMMAND SECTION
112
112A
113
OUTPUT CONVERSION SECTION
121
122
123
Max
124
125
126
127
128
106
OUTPUT CONVERSION SECTION
100
208
8
7
V
13A
REG
13
9A
INV
14
G
15A
REG
15
10A
REG
10
74
210A

WORK MACHINE

TECHNICAL FIELD

The present invention relates to a work machine such as a hydraulic excavator, and more particularly to a work machine capable of regenerating a return hydraulic fluid from a hydraulic actuator.

BACKGROUND ART

For example, Patent Document 1 discloses a conventional technology of a work machine capable of regenerating a return hydraulic fluid from a hydraulic actuator.

Patent Document 1 discloses a hydraulic fluid energy regeneration device for a work machine. The hydraulic fluid energy regeneration device includes a regeneration hydraulic motor, a hydraulic pump, and an electric motor. The regeneration hydraulic motor is driven by a return hydraulic fluid discharged by a hydraulic actuator. The hydraulic pump is mechanically coupled to the regeneration hydraulic motor. With this hydraulic fluid energy regeneration device, the hydraulic pump mechanically coupled to the regeneration hydraulic motor can be directly driven by recovered energy. This eliminates losses that result from temporary energy storage. This, as a result, makes it possible to reduce energy conversion losses, leading to efficient use of energy.

PRIOR ART DOCUMENT

Patent Document

Patent Document 1: WO2015/173963

SUMMARY OF THE INVENTION

Problems to be Solved by the Invention

However, there are problems in the hydraulic fluid energy regeneration device for the work machine disclosed in Patent Document 1. In the hydraulic fluid energy regeneration device, the revolution speed of the electric motor is controlled according to a target flow rate of the return hydraulic fluid or a constant revolution speed command. Therefore, when the revolution speed of the electric motor becomes excessive relative to the power regenerated by the regeneration hydraulic motor (regeneration power) or the power of the hydraulic pump (pump power), a drag loss of the regeneration hydraulic pump and the hydraulic pump increases. When the revolution speed of the electric motor becomes insufficient relative to the regeneration power or the pump power, the regeneration efficiency of the regeneration hydraulic motor decreases.

The present invention has been made in view of the problems described above. It is an object of the present invention to provide a work machine capable of regenerating a return hydraulic fluid from a hydraulic actuator while preventing a drag loss of a regeneration hydraulic motor and a hydraulic pump from increasing and preventing the regeneration efficiency of the regeneration hydraulic motor from decreasing.

Means for Solving the Problems

In order to achieve the object described above, the present invention provides a work machine including: a first hydraulic actuator; a second hydraulic actuator; a regeneration hydraulic motor that is driven by a return hydraulic fluid discharged from the first hydraulic actuator; a first hydraulic pump mechanically coupled to the regeneration hydraulic motor; an electric motor mechanically coupled to the regeneration hydraulic motor; a second hydraulic pump that delivers a hydraulic fluid for driving the first hydraulic actuator or the second hydraulic actuator; a junction line that allows a hydraulic fluid delivered by the first hydraulic pump to join a hydraulic fluid delivered by the second hydraulic pump; a first operation device that directs an operation of the first hydraulic actuator; a first operation amount sensor that detects an operation amount of the first operation device; a second operation device that directs an operation of the second hydraulic actuator; a second operation amount sensor that detects an operation amount of the second operation device; a first pressure sensor that detects a pressure in the first hydraulic actuator; a second pressure sensor that detects a pressure of the second hydraulic pump; and a controller configured to receive signals of the first operation amount sensor, the second operation amount sensor, the first pressure sensor, and the second pressure sensor and output a control command to the electric motor, the controller being configured to: compute a regeneration flow rate and a regeneration power of the regeneration hydraulic motor from the operation amount of the first operation device and the pressure in the first hydraulic actuator; compute a pump power of the second hydraulic pump from the operation amount of the second operation device and the pressure of the second hydraulic pump and set a smaller one of the regeneration power and the pump power as an assist power of the first hydraulic pump; and compute a target assist flow rate from the assist power and the pressure of the second hydraulic pump, in which the controller is configured to: compute a required regeneration hydraulic motor revolution speed from a regeneration hydraulic motor displacement and the regeneration flow rate, the required regeneration hydraulic motor revolution speed being a required revolution speed of the regeneration hydraulic motor, the regeneration hydraulic motor displacement being a displacement of the regeneration hydraulic motor; compute a required first hydraulic pump revolution speed from a first hydraulic pump displacement and the target assist flow rate, the required first hydraulic pump revolution speed being a required revolution speed of the first hydraulic pump, the first hydraulic pump displacement being a displacement of the first hydraulic pump; and select a greater one of the required regeneration hydraulic motor revolution speed and the required first hydraulic pump revolution speed as a target electric motor revolution speed, the target electric motor revolution speed being a target revolution speed of the electric motor.

According to the present invention configured as described above, a greater one of the required revolution speed of the regeneration hydraulic motor and the required revolution speed of the first hydraulic pump is selected as the target revolution speed of the electric motor. This configuration can prevent a drag loss of the regeneration hydraulic motor and the first hydraulic pump from increasing due to excessive revolution speed of the electric motor and prevent the regeneration efficiency of the regeneration hydraulic motor from decreasing due to insufficient revolution speed of the electric motor.

Advantages of the Invention

According to the present invention, it is possible to prevent a drag loss of a regeneration hydraulic motor and an auxiliary hydraulic pump from increasing and prevent the regeneration efficiency of the regeneration hydraulic motor from decreasing in a work machine capable of regenerating a return hydraulic fluid from a hydraulic actuator.

MODES FOR CARRYING OUT THE INVENTION

Figure 1:
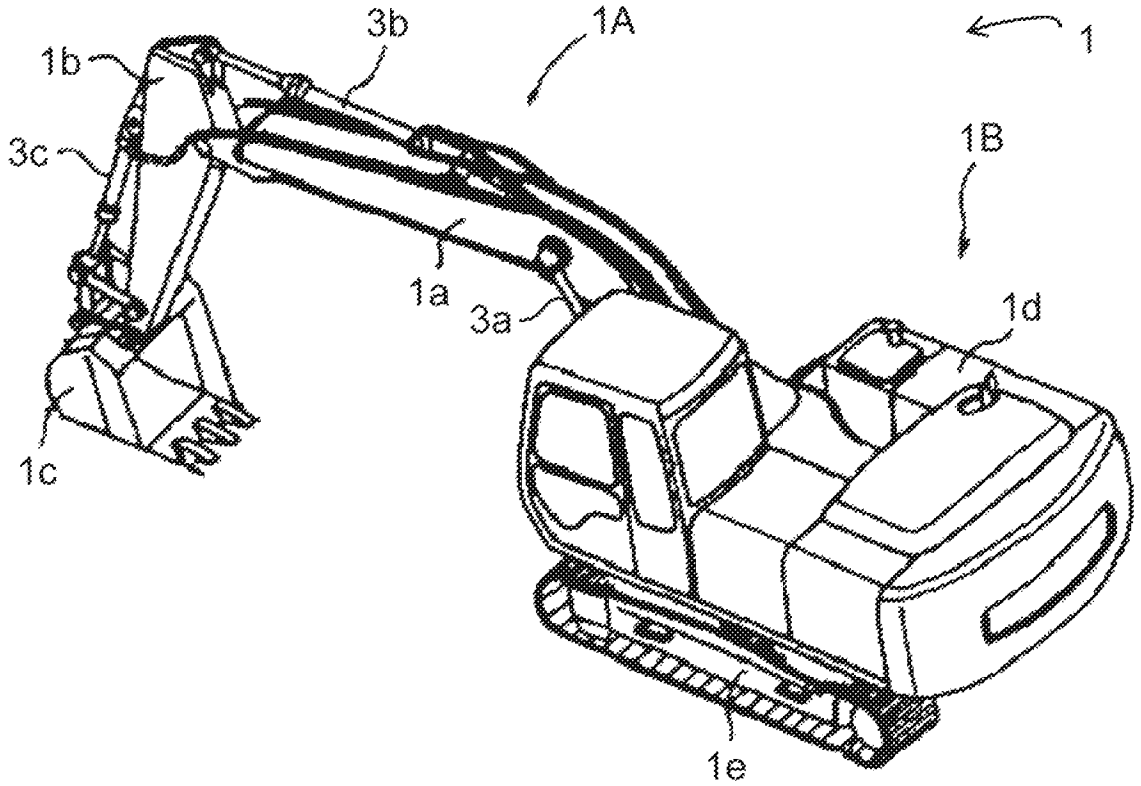
FIG. 1 is a perspective view of a hydraulic excavator as an example of a work machine according to an embodiment of the present invention.

Hereinafter, a hydraulic excavator will be described as an example of a work machine according to an embodiment of the present invention with reference to the drawings. It is noted that like reference characters designate identical or corresponding components in each figure, and redundant description will be omitted as appropriate.

Figure 2:
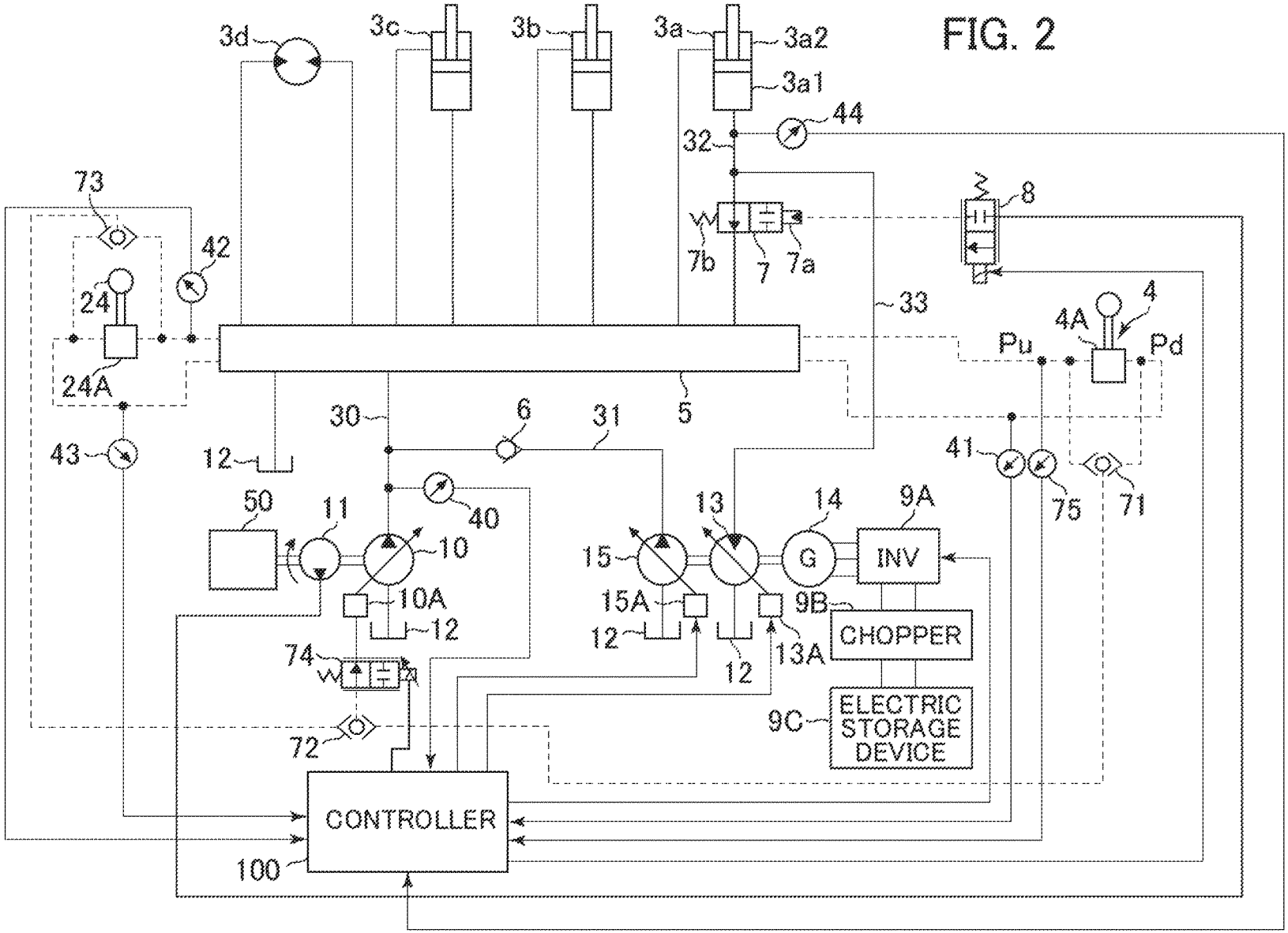
FIG. 2 is a schematic diagram of a drive control system mounted in the hydraulic excavator illustrated in FIG. 1.

FIG. 1 is a perspective view of a hydraulic excavator according to the present embodiment. FIG. 2 is a schematic diagram of a drive control system mounted in the hydraulic excavator illustrated in FIG. 1.

In FIG. 1, a hydraulic excavator 1 includes an articulated work device 1A and a machine body 1B. The work device 1A includes a boom 1*a*, an arm 1*b*, and a bucket 1*c*. The machine body 1B includes an upper swing structure 1*d* and a lower track structure 1*e*. The boom 1*a* is turnably supported by the upper swing structure 1*d* and is driven by a boom cylinder (hydraulic cylinder) 3*a*. The boom cylinder 3*a* acts as a first hydraulic actuator. The upper swing structure 1*d* is swingably provided on the lower track structure 1*e*. The upper swing structure 1*d* is driven to be swung by a swing motor 3*d* (illustrated in FIG. 2).

The arm 1*b* is turnably supported by the boom 1*a* and is driven by an arm cylinder (hydraulic cylinder) 3*b*. The bucket 1*c* is turnably supported by the arm 1*b* and is driven by a bucket cylinder (hydraulic cylinder) 3*c*. The lower track structure 1*e* is driven by right and left track motors (not illustrated). The driving of the boom cylinder 3*a*, the arm cylinder 3*b*, and the bucket cylinder 3*c* is controlled by operation devices 4 and 24 (see FIG. 2) that output respective hydraulic signals. The operation devices 4 and 24 are installed in a cabin (cab) of the upper swing structure 1*d*.

The drive control system illustrated in FIG. 2 includes a power regeneration device 70, the operation devices 4 and 24, a control valve 5, a check valve 6, a selector valve 7, a solenoid selector valve 8, an inverter 9A, a chopper 9B, an electric storage device 9C, and a controller 100. The control valve 5 includes a plurality of spool-type directional control valves. The controller 100 acts as a control device.

A variable displacement hydraulic pump 10, a pilot hydraulic pump 11, and a tank 12 are included as hydraulic fluid source devices. The hydraulic pump 10 acts as a second hydraulic pump. The pilot hydraulic pump 11 supplies a pilot hydraulic fluid. The hydraulic pump 10 and the pilot hydraulic pump 11 are driven by an engine 50 coupled thereto by a drive shaft. The hydraulic pump 10 includes a regulator 10A. The regulator 10A adjusts a delivery flow rate of the hydraulic pump 10 by controlling the swash plate tilting angle of the hydraulic pump 10 by a control pressure outputted from a solenoid proportional valve 74 described later.

An auxiliary hydraulic line 31, the control valve 5, and a pressure sensor 40 are provided in a hydraulic line 30. The hydraulic line 30 supplies a hydraulic fluid from the hydraulic pump 10 to the boom cylinder 3*a* to the swing motor 3*d*. The auxiliary hydraulic line 31 acts as a junction line and is coupled to the hydraulic line 30 via the check valve 6 described later. The control valve 5 includes the plurality of spool-type directional control valves that control the direction and flow rate of the hydraulic fluid to be supplied to each actuator. The pressure sensor 40 acts as a second pressure sensor and detects a delivery pressure of the hydraulic pump 10. With the pilot hydraulic fluid supplied to pilot pressure receiving sections of the control valve 5, the control valve 5 switches the spool position of each directional control valve and supplies the hydraulic fluid from the hydraulic pump 10 to each hydraulic actuator to drive the arm 1*b* and the like. The pressure sensor 40 outputs the detected delivery pressure of the hydraulic pump 10 to the controller 100 described later.

The spool position of each directional control valve of the control valve 5 is switched by the operations of operation levers or the like of the operation devices 4 and 24. When the operation levers or the like are operated, the operation devices 4 and 24 supply pilot primary hydraulic fluids, which are supplied from the pilot hydraulic pump 11 via pilot primary-side hydraulic lines, not illustrated, to the pilot pressure receiving sections of the control valve 5 via pilot secondary-side hydraulic lines. Here, the operation device 4 is a first operation device that directs the operation of the boom cylinder 3*a* (first hydraulic actuator). The operation device 24 acts as a second operation device and collectively represents devices that direct the operation of the actuators (second hydraulic actuators) other than the boom cylinder 3*a*.

A pilot valve 4A is provided inside the operation device 4. The operation device 4 is connected via pilot lines to the pressure receiving section of the corresponding spool-type directional control valve of the control valve 5 that controls driving of the boom cylinder 3*a*. The pilot valve 4A outputs a hydraulic signal to the corresponding pilot pressure receiving section of the control valve 5 according to the inclination direction and the operation amount of the operation lever of the operation device 4. The spool-type directional control valve that controls driving of the boom cylinder 3*a* is switched in position according to the hydraulic signal inputted from the operation device, and controls the flow of the hydraulic fluid delivered from the hydraulic pump 10 according to the switching position. In this manner, the spool-type directional control valve controls driving of the boom cylinder 3*a*. Here, a pressure sensor 75 is mounted in the pilot line through which a hydraulic signal (boom raising operation signal Pu) passes. The hydraulic signal (boom raising operation signal Pu) is for driving the boom cylinder 3*a* such that the boom 1*a* operates in the raising direction. The pressure sensor 75 outputs the detected boom raising operation signal Pu to the controller 100 described later. Further, a pressure sensor 41 acts as a first operation amount sensor and is mounted in the pilot line through which a hydraulic signal (boom lowering operation signal Pd) passes. The hydraulic signal (boom lowering operation signal Pd) is for driving the boom cylinder 3*a* such that the boom 1*a* operates in the lowering direction. The pressure sensor 41 outputs the detected boom lowering operation signal Pd to the controller 100 described later.

A pilot valve 24A is provided inside the operation device 24. The operation device 24 is connected via pilot lines to the pressure receiving sections of the respective spool-type directional control valves of the control valve 5 that control driving of the actuators other than the boom cylinder 3*a*. The pilot valve 24A outputs a hydraulic signal to the corresponding pilot pressure receiving section of the control valve 5 according to the inclination direction and the operation amount of the operation lever of the operation device 24. The spool-type directional control valve that controls driving of a corresponding one of the actuators is switched in position according to the hydraulic signal inputted from the operation device, and controls the flow of the hydraulic fluid delivered from the hydraulic pump 10 according to the switching position. In this manner, the spool-type directional control valve controls driving of the corresponding actuator.

Pressure sensors 42 and 43 are provided in the two systems of the pilot lines connecting the pilot valve 24A of the operation device 24 and the pressure receiving sections of the control valve 5. The pressure sensors 42 and 43 act as second operation amount sensors and detect the respective pilot pressures. Each of the pressure sensors 42 and 43 outputs a detected operation amount signal of the operation device 24 to the controller 100 described later.

Each of the raising-side pilot pressure Pu and the lowering-side pilot pressure Pd outputted from the pilot valve 4A inside the operation device 4 is inputted into a high pressure selection valve 71, and one of the pressures that is higher is selected. Each of the pilot pressures outputted from the pilot valve 24A inside the operation device 24 is inputted into a high pressure selection valve 73, and one of the pressures that is higher is selected. The pressures selected by the high pressure selection valves 71 and 73 are inputted into a high pressure selection valve 72, and one of the inputted pressures that is higher is selected. In other words, the highest pressure among the pressures outputted from the pilot valves 4A and 24A is selected by the high pressure selection valves 71, 72, and 73 and is inputted into the solenoid proportional valve 74.

The solenoid proportional valve 74 reduces the inputted pressure to a desired pressure according to a command from the controller 100, and outputs the pressure to the regulator 10A of the hydraulic pump 10. The regulator 10A controls the hydraulic pump 10 such that the displacement volume is proportional to the inputted pressure.

Next, the power regeneration device 70 will be described. The power regeneration device 70 includes a bottom-side hydraulic line 32, a regeneration circuit 33, the selector valve 7, the solenoid selector valve 8, the inverter 9A, the chopper 9B, the electric storage device 9*c*, a variable displacement hydraulic motor 13, an electric motor 14, a variable displacement hydraulic pump 15, and the controller 100. The variable displacement hydraulic motor 13 acts as a regeneration hydraulic motor. The variable displacement hydraulic pump 15 acts as an auxiliary hydraulic pump (first hydraulic pump). The regeneration hydraulic motor 13 includes a regulator 13A. The regulator 13A controls the swash plate tilting angle of the hydraulic motor 13 according to a command from the controller 100 described later.

The bottom-side hydraulic line 32 is a hydraulic line through which a hydraulic fluid (return hydraulic fluid) returning to the tank 12 flows at the time of contraction of the boom cylinder 3*a*. One end side of the bottom-side hydraulic line 32 is connected to a bottom-side hydraulic chamber 3*a*1 of the boom cylinder 3*a*, while the other end side of the bottom-side hydraulic line 32 is connected to a connection port of the control valve 5. In the bottom-side hydraulic line 32, a pressure sensor 44 and the selector valve 7 are provided. The pressure sensor 44 acts as a first pressure sensor and detects the pressure in the bottom-side hydraulic chamber 3*a*1 of the boom cylinder 3*a*. The selector valve 7 switches whether to discharge the return hydraulic fluid from the bottom-side hydraulic chamber 3*a*1 of the boom cylinder 3*a* to the tank 12 via the control valve 5. The pressure sensor 44 outputs the detected pressure in the bottom-side hydraulic chamber 3*a*1 to the controller 100 described later.

The selector valve 7 includes a spring 7*b* on one end side thereof and a pilot pressure receiving section 7*a* on the other end side thereof. By switching the spool position depending on whether the pilot hydraulic fluid is supplied to the pilot pressure receiving section 7*a*, the selector valve 7 controls communication/interruption of the return hydraulic fluid flowing from the bottom-side hydraulic chamber 3*a*1 of the boom cylinder 3*a* into the control valve 5. The pilot hydraulic fluid is supplied from the pilot hydraulic pump 11 to the pilot pressure receiving section 7*a* via the solenoid selector valve 8 described later.

The hydraulic fluid outputted from the pilot hydraulic pump 11 is inputted into an input port of the solenoid selector valve 8. By contrast, a command signal outputted from the controller 100 is inputted into an operation section of the solenoid selector valve 8. According to this command signal, the solenoid selector valve 8 controls supply/interruption of the pilot hydraulic fluid, which has been supplied from the pilot hydraulic pump 11, to the pilot pressure receiving section 7*a* of the selector valve 7.

One end of the regeneration circuit 33 is connected between the selector valve 7 in the bottom-side hydraulic line 32 and the bottom-side hydraulic chamber 3*a*1 of the boom cylinder 3*a*, while the other end of the regeneration circuit 33 is connected to an inlet of the hydraulic motor 13. With this arrangement, the return hydraulic fluid from the bottom-side hydraulic chamber 3*a*1 is guided to the tank 12 via the regeneration hydraulic motor 13.

The regeneration hydraulic motor 13 is mechanically coupled to the auxiliary hydraulic pump 15. The auxiliary hydraulic pump 15 is rotated by the driving force of the hydraulic motor 13.

One end side of the auxiliary hydraulic line 31 is connected to a delivery port of the auxiliary hydraulic pump 15, which acts as the first hydraulic pump, while the other end side of the auxiliary hydraulic line 31 is connected to the hydraulic line 30. The check valve 6 is provided in the auxiliary hydraulic line 31. The check valve 6 allows the hydraulic fluid from the auxiliary hydraulic pump 15 to flow into the hydraulic line 30 while preventing the hydraulic fluid from the hydraulic line 30 to flow into the auxiliary hydraulic pump 15.

The auxiliary hydraulic pump 15 includes a regulator 15A. The regulator 15A adjusts a delivery flow rate of the auxiliary hydraulic pump 15 by controlling the swash plate tilting angle of the auxiliary hydraulic pump 15 by a command from the controller 100 described later.

The hydraulic motor 13 is further mechanically coupled to the electric motor 14. Electric power is generated by the driving force of the hydraulic motor 13. The electric motor 14 is electrically connected to the inverter 9A, the chopper 9B, and the electric storage device 9C. The inverter 9A controls the revolution speed. The chopper 9B boots voltage. The electric storage device 9C stores generated electric energy.

The controller 100 receives the raising-side pilot pressure signal Pu of the pilot valve 4A of the operation device 4 detected by the pressure sensor 75, the lowering-side pilot pressure signal Pd of the pilot valve 4A of the operation device 4 detected by the pressure sensor 41, pilot pressure signals of the pilot valve 24A of the operation device 24 detected by the pressure sensors 42 and 43, and a pressure signal of the bottom-side hydraulic chamber 3*a*1 of the boom cylinder 3*a* detected by the pressure sensor 44. The controller 100 performs calculation based on these inputted values and outputs respective control commands to the solenoid selector valve 8, the inverter 9A, the solenoid proportional valve 74, the regulator 13A of the regeneration hydraulic motor 13, and the regulator 15A of the auxiliary hydraulic pump 15.

The solenoid selector valve 8 is switched by a command signal from the controller 100 and supplies the hydraulic fluid from the pilot hydraulic pump 11 to the selector valve 7. The inverter 9A is controlled to a desired revolution speed by a signal from the controller 100. The solenoid proportional valve 74 controls the displacement of the hydraulic pump 10 by outputting a pressure based on a command from the controller 100. The regeneration hydraulic motor 13 is controlled to a desired displacement by a command from the controller. The auxiliary hydraulic pump 15 is controlled to a desired displacement by a signal from the controller 100.

Next, the operation of the hydraulic excavator 1 according to the present embodiment described above will be described.

First, when the operation lever of the operation device 4 illustrated in FIG. 2 is operated in the boom lowering direction, the pilot pressure Pd is transmitted from the pilot valve 4A to the corresponding pilot pressure receiving section of the control valve 5, causing the spool-type directional control valve of the control valve 5 that controls driving of the boom cylinder 3*a* to perform the switching operation. This causes the hydraulic fluid from the hydraulic pump 10 to flow into a rod-side hydraulic chamber 3*a*2 of the boom cylinder 3*a* via the control valve 5. This, as a result, causes a piston rod of the boom cylinder 3*a* to perform the contraction operation. Accordingly, the return hydraulic fluid discharged from the bottom-side hydraulic chamber 3*a*1 of the boom cylinder 3*a* is guided to the tank 12 through the selector valve 7 and the control valve 5 that are in communication with the bottom-side hydraulic line 32.

At this point, the controller 100 receives the delivery pressure signal of the hydraulic pump 10 detected by the pressure sensor 40, the pressure signal of the bottom-side hydraulic chamber 3*a*1 of the boom cylinder 3*a* detected by the pressure sensor 44, the raising-side pilot pressure signal Pu of the pilot valve 4A detected by the pressure sensor 75, and the lowering-side pilot pressure signal Pd of the pilot valve 4A detected by the pressure sensor 41.

In this state, when the operation lever of the operation device 4 is operated equal to or greater than a specified value by an operator in the boom lowering direction, the controller 100 outputs a switching command to the solenoid selector valve 8, a revolution speed command to the inverter 9A, displacement commands to the regulator 13A of the regeneration hydraulic motor 13 and the regulator 15A of the auxiliary hydraulic pump 15, and a control command to the solenoid proportional valve 74.

As a result, the selector valve 7 is switched to the interruption position, causing the hydraulic line to the control valve 5 to be interrupted. Therefore, the return hydraulic fluid from the bottom-side hydraulic chamber 3*a*1 of the boom cylinder 3*a* flows into the regeneration circuit 33 and drives the hydraulic motor 13. After that, the return hydraulic fluid is discharged to the tank 12. At this point, the flow rate (bottom-side flow rate) discharged from the bottom-side hydraulic chamber 3*a*1 of the boom cylinder 3*a* is the flow rate (regeneration flow rate) regenerated by the regeneration hydraulic motor 13.

The auxiliary hydraulic pump 15 is rotated by the driving force of the regeneration hydraulic motor 13. The hydraulic fluid delivered from the auxiliary hydraulic pump 15 joins the hydraulic fluid delivered from the hydraulic pump 10 via the auxiliary hydraulic line 31 and the check valve 6. The controller 100 outputs a displacement command to the regulator 15A of the auxiliary hydraulic pump 15 such that the power of the hydraulic pump 10 is assisted. The controller 100 outputs a control command to the solenoid proportional valve 74 such that the displacement of the hydraulic pump 10 is reduced by the flow rate of the hydraulic fluid supplied from the auxiliary hydraulic pump 15.

Of the hydraulic energy inputted into the regeneration hydraulic motor 13, excess energy that has not been consumed by the auxiliary hydraulic pump 15 is used to drive the electric motor 14 to generate electric power. The electric energy generated by the electric motor 14 is stored in the electric storage device 9C.

In the present embodiment, the energy of the hydraulic fluid discharged from the boom cylinder 3*a* is recovered by the regeneration hydraulic motor 13, and then used to assist the power of the hydraulic pump 10 as the driving force of the auxiliary hydraulic pump 15. Further, excess power is stored in the electric storage device 9C via the electric motor 14. In this manner, effective use of energy and reduction in fuel consumption are achieved.

Figure 3:
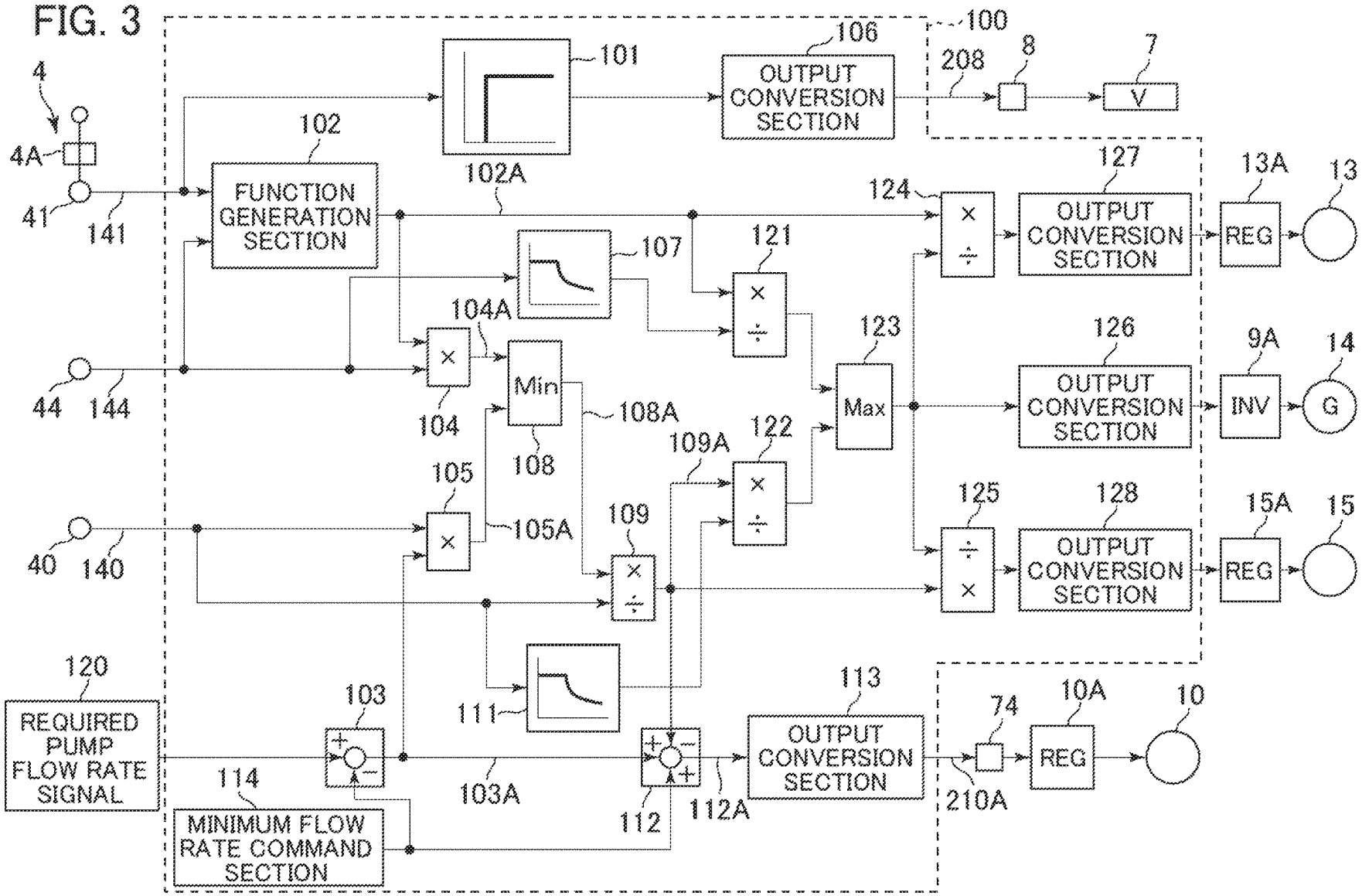
FIG. 3 is a block diagram of a controller illustrated in FIG. 2.
Figure 4:
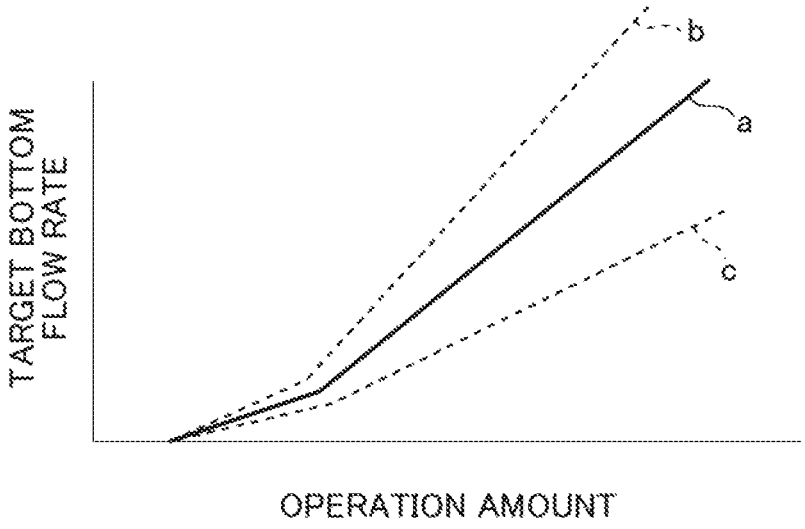
FIG. 4 is a characteristic diagram for describing a second function generation section of the controller illustrated in FIG. 3.

Next, the control of the controller 100 will be described with reference to FIGS. 3, 4, and 5. FIG. 3 is a block diagram of the controller 100.

As illustrated in FIG. 3, the controller 100 includes a first function generation section 101, a second function generation section 102, a first subtraction section 103, a first multiplication section 104, a second multiplication section 105, a first output conversion section 106, a third function generation section 107, a minimum value selection section 108, a first division section 109, a fourth function generation section 111, a second subtraction section 112, a second output conversion section 113, a minimum flow rate command section 114, a second division section 121, a third division section 122, a maximum value selection section 123, a fourth division section 124, a fifth division section 125, a third output conversion section 126, a fourth output conversion section 127, and a fifth output conversion section 128.

The first function generation section 101 receives, as a lever operation signal 141, the lowering-side pilot pressure Pd of the pilot valve 4A of the operation device 4 detected by the pressure sensor 41. A switching start point for the lever operation signal 141 is stored in a table of the first function generation section 101 in advance.

When the lever operation signal 141 is equal to or smaller than the switching start point, the first function generation section 101 outputs an OFF signal to the first output conversion section 106. When the lever operation signal 141 exceeds the switching start point, the first function generation section 101 outputs an ON signal to the first output conversion section 106. The first output conversion section 106 converts the inputted signal into a control signal for the solenoid selector valve 8 and outputs the control signal to the solenoid selector valve 8 as a solenoid valve command signal 208. This causes the solenoid selector valve 8 to operate. This, in turn, causes the selector valve 7 to be switched and the hydraulic fluid in the bottom-side hydraulic chamber 3*a*1 of the boom cylinder 3*a* to flow into the regeneration circuit 33.

The lowering-side pilot pressure Pd is inputted into one input end of the second function generation section 102 as the lever operation signal 141. The pressure in the bottom-side hydraulic chamber 3*a*1 of the boom cylinder 3*a* detected by the pressure sensor 44 is inputted into another input end of the second function generation section 102 as a pressure signal 144. Based on these inputted signals, the second function generation section 102 computes a target bottom flow rate signal 102A of the boom cylinder 3*a*.

The calculation of the second function generation section 102 will be described in detail with reference to FIG. 4. FIG. 4 is a characteristic diagram for describing the second function generation section 102. In FIG. 4, the horizontal axis represents the operation amount of the lever operation signal 141, while the vertical axis represents a target bottom flow rate (a target flow rate of the return hydraulic fluid flowing out of the bottom-side hydraulic chamber 3*a*1 of the boom cylinder 3*a*). In FIG. 4, a basic characteristic line a indicated by a solid line is set in order to obtain a characteristic equivalent to conventional control of the return hydraulic fluid by the control valve 5. A characteristic line b indicated by an upper broken line and a characteristic line c indicated by a lower broken line represent a case where the characteristic line a is corrected by the pressure signal 144 of the bottom-side hydraulic chamber 3*a*1.

Specifically, when the pressure signal 144 of the bottom-side hydraulic chamber 3*a*1 increases, the inclination of the basic characteristic line a increases and is corrected in the direction of the characteristic line b, which leads to a continuous change in the characteristic. Conversely, when the pressure signal 144 decreases, the inclination of the basic characteristic line a decreases and is corrected in the direction of the characteristic line c, which leads to a continuous change in the characteristic. In this manner, the second function generation section 102 computes a target bottom flow rate signal serving as a base according to the lever operation signal 141 and corrects the target bottom flow rate signal serving as a base according to the change in the pressure signal 144 of the bottom-side hydraulic chamber 3*a*1, thereby computing the final target bottom flow rate signal 102A.

Returning to FIG. 3, the second function generation section 102 outputs the target bottom flow rate signal 102A to the fourth division section 124 and the first multiplication section 104.

The pressure signal 144 is inputted into the third function generation section 107. The third function generation section 107 computes a required displacement of the regeneration hydraulic motor 13 according to the pressure signal 144. The characteristic of the third function generation section 107 is such that the third function generation section 107 lowers the displacement as the bottom pressure increases. This is because, since the maximum torque is set for the electric motor 14, controlling the regeneration hydraulic motor 13 to a large displacement with high pressure may result in overspeed exceeding the maximum torque of the electric motor 14. For this reason, the displacement of the regeneration hydraulic motor 13 is controlled such that the displacement is lowered and the torque borne by the electric motor 14 is lowered at the time of high pressure. Another reason is to attain a large displacement as much as possible when the pressure is not high. This is because it is generally more efficient to control a hydraulic motor with a large displacement.

The required displacement from the third function generation section 107 and the target bottom flow rate signal 102A are inputted into the second division section 121. The second division section 121 computes a required regeneration hydraulic motor revolution speed by dividing the target bottom flow rate signal 102A by the required flow rate and outputs the required regeneration hydraulic motor revolution speed to the maximum value selection section 123.

The first subtraction section 103 receives a minimum flow rate signal from the minimum flow rate command section 114 and a required pump flow rate signal 120, and computes a deviation therebetween as a required pump flow rate signal 103A. The first subtraction section 103 outputs the required pump flow rate signal 103A to the second multiplication section 105 and the second subtraction section 112. Here, a method for computing the required pump flow rate signal 120 will be described with reference to FIG. 5. FIG. 5 is a block diagram for describing how the controller 100 controls the flow rate of the hydraulic pump.

Figure 5:
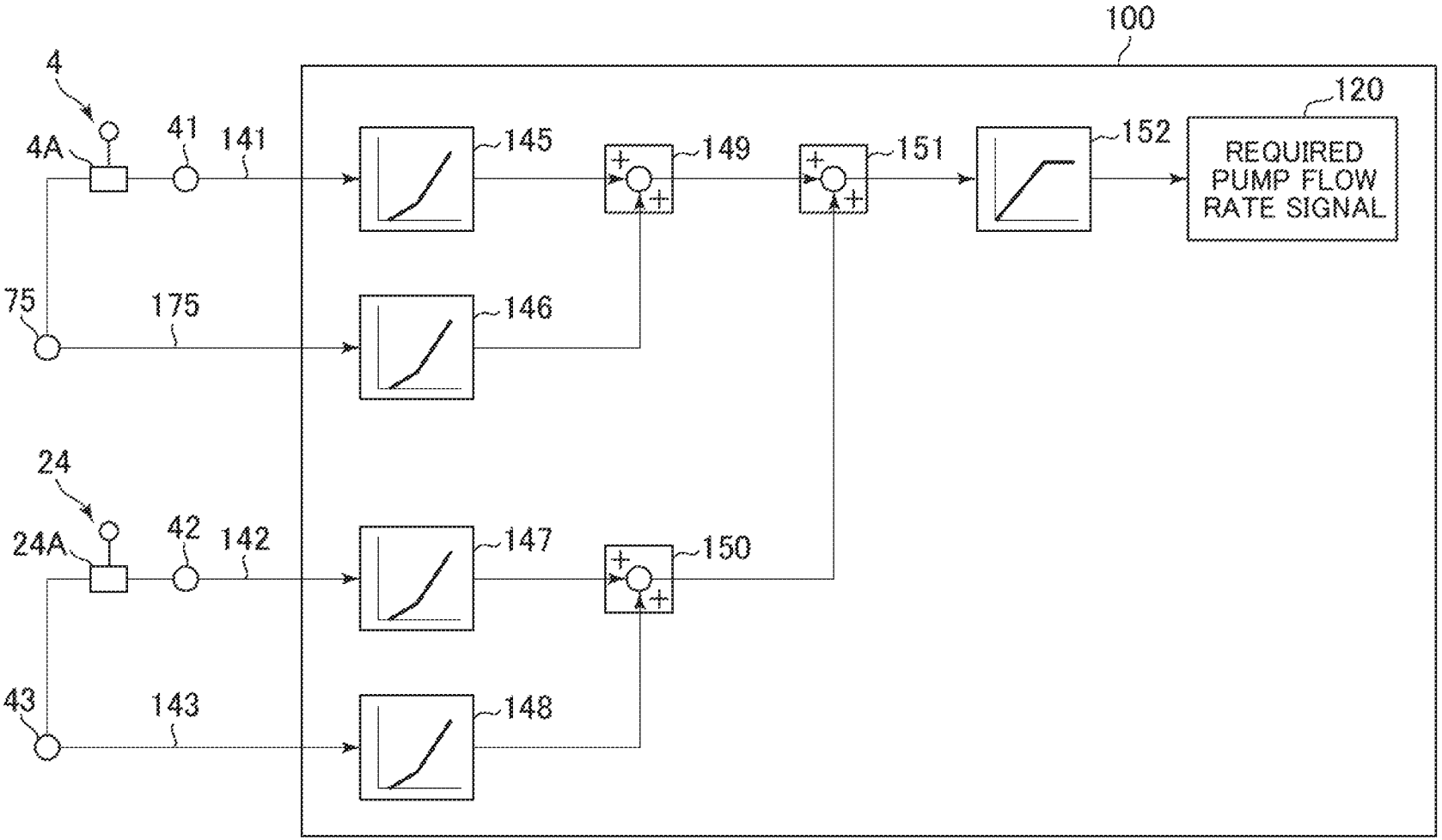
FIG. 5 is a block diagram for describing how the controller controls a flow rate of a hydraulic pump.

With reference to FIG. 5, the pressures of individual pilot valves are detected by the pressure sensors 41, 75, 42, and 43 and are outputted to the controller 100 as lever operation signals 141, 175, 142, and 143, respectively.

In the controller 100, function generation sections 145, 146, 147, and 148 corresponding to individual lever operation signals compute respective required pump flow rates such that the required pump flow rate signal 120 based on each lever operation signal is obtained. The required pump flow rates computed by the respective function generation sections are summed by addition sections 149, 150, and 151. This is a calculation for securing a necessary hydraulic pump flow rate when a combined operation is performed. Then, a function generation section 152 cuts off the total value of the required pump flow rates outputted from the addition section 151 at an upper limit. This is because there is an upper limit on the flow rate that can be delivered by the hydraulic pump 10. The upper limit in the function generation section 152 is a value that is obtained from the maximum displacement of the hydraulic pump 10.

In this manner, this control logic computes, without excess or deficiency, the flow rate based on each lever operation signal. At the time of a combined operation, the control logic figures as much flow rate as necessary and computes the required pump flow rate signal 120 without exceeding the upper limit of the flow rate that can be delivered by the hydraulic pump 10.

Returning to FIG. 3, the first multiplication section 104 receives the target bottom flow rate signal 102A from the second function generation section 102 and the pressure signal 144 of the bottom-side hydraulic chamber 3*a*1. The first multiplication section 104 computes a multiplication value of these signals as a regeneration power signal 104A and outputs the regeneration power signal 104A to the minimum value selection section 108.

One input end of the second multiplication section 105 receives the delivery pressure of the hydraulic pump 10 detected by the pressure sensor 40 as a pressure signal 140. Another input end of the second multiplication section 105 receives the required pump flow rate signal 103A computed by the first subtraction section 103. The second multiplication section 105 computes a multiplication value of these signals as a required pump power signal 105A and outputs the required pump power signal 105A to the minimum value selection section 108.

The minimum value selection section 108 receives the regeneration power signal 104A from the first multiplication section 104 and the required pump power signal 105A from the second multiplication section 105, and selects a smaller one of these signals as a target assist power signal 108A of the auxiliary hydraulic pump 15. The minimum value selection section 108 outputs the target assist power signal 108A to the first division section 109.

Here, considering the efficiency of the equipment, using the recovered power in the auxiliary hydraulic pump 15 as much as possible can reduce losses and is therefore more efficient than causing the electric motor 14 to convert the recovered power into electric energy and store the electric energy in the electric storage device 9C for reuse. For this reason, the minimum value selection section 108 selects a smaller one of the regeneration power signal 104A and the required pump power signal 105A. With this configuration, the regeneration power can be supplied to the auxiliary hydraulic pump 15 as much as possible without exceeding the required pump power signal 105A.

The first division section 109 receives the target assist power signal 108A from the minimum value selection section 108 and the pressure signal 140 of the delivery pressure of the hydraulic pump 10. The first division section 109 computes a target assist flow rate signal 109A by dividing the target assist power signal 108A by the pressure signal 140, and outputs the target assist flow rate signal 109A to the third division section 122, the second subtraction section 112, and the fifth division section 125.

The pressure signal 140 is inputted into the fourth function generation section 111. The fourth function generation section 111 computes the required displacement of the auxiliary hydraulic pump 15 according to the pressure signal 140. The characteristic of the fourth function generation section 111 is such that the fourth function generation section 111 lowers the displacement as the pump pressure increases. This is because, since the maximum torque is set for the electric motor 14, controlling the auxiliary hydraulic pump 15 to a large displacement with high pressure may result in overspeed exceeding the maximum torque of the electric motor 14. For this reason, the displacement of the auxiliary hydraulic pump 15 is controlled such that the displacement is lowered and the torque borne by the electric motor 14 is lowered at the time of high pressure. Another reason is to attain a large displacement as much as possible when the pressure is not high. This is because it is generally more efficient to control a hydraulic pump with a large displacement.

The required displacement from the fourth function generation section 111 and the target assist flow rate signal 109A are inputted into the third division section 122. The third division section 122 computes a required auxiliary hydraulic pump revolution speed by dividing the target assist flow rate signal 109A by the required displacement and outputs the required auxiliary hydraulic pump revolution speed to the maximum value selection section 123.

The maximum value selection section 123 selects a larger one of the inputted signals as a target electric motor revolution speed and inputs the larger one to the third output conversion section 126, the fourth division section 124, and the fifth division section 125. The third output conversion section 126 converts the inputted target electric motor revolution speed into a command signal for the inverter 9A and outputs the command signal to the inverter 9A.

The fourth division section 124 computes a target displacement signal for the regeneration hydraulic motor 13 by dividing the target bottom flow rate signal 102A from the second function generation section 102 by the target electric motor revolution speed from the maximum value selection section 123. The target displacement signal for the regeneration hydraulic motor 13 is inputted into the fourth output conversion section 127. The fourth output conversion section 127 converts the inputted target displacement signal for the regeneration hydraulic motor 13 into a command signal for the regulator 13A and outputs the command signal to the regulator 13A.

The fifth division section 125 computes a target displacement signal for the auxiliary hydraulic pump 15 by dividing the target assist flow rate signal 109A from the first division section 109 by the target electric motor revolution speed from the maximum value selection section 123. The target displacement signal for the auxiliary hydraulic pump 15 is inputted into the fifth output conversion section 128. The fifth output conversion section 128 converts the inputted target displacement signal for the auxiliary hydraulic pump 15 into a command signal for the regulator 15A and outputs the command signal to the regulator 15A.

Since a greater one of the required revolution speed of the regeneration hydraulic motor 13 and the required revolution speed of the auxiliary hydraulic pump 15 is selected as the target electric motor revolution speed as a result of the calculation described above, the revolution speed of the regeneration hydraulic motor 13 or the auxiliary hydraulic pump 15 whose required revolution speed is smaller becomes greater than the required revolution speed. However, it is possible to regenerate or deliver the target flow rate by reducing the displacement of the regeneration hydraulic motor 13 or the auxiliary hydraulic pump 15 whose required revolution speed is smaller.

By controlling in this manner, moreover, when there is no regeneration power, the electric motor 14 does not rotate even when the required pump flow rate signal is inputted. Therefore, it is possible to suppress an unnecessary drag loss of the regeneration hydraulic motor 13 or the auxiliary hydraulic pump 15. On the other hand, when there is regeneration power and the required pump flow rate signal is inputted (at the time of assisting the power of the hydraulic pump 10), the electric motor 14 is actively rotated. Therefore, it is possible to reuse the hydraulic energy as the driving force of the auxiliary hydraulic pump 15 without converting the hydraulic energy into electric energy. As a matter of course, when there is regeneration power and the required pump flow rate signal is not inputted (at the time of not assisting the power of the hydraulic pump 10), it is possible to store regeneration energy obtained by rotating the electric motor as electric energy.

The second subtraction section 112 receives the required pump flow rate signal 103A from the first subtraction section 103, the target assist flow rate signal 109A from the first division section 109, and the minimum flow rate signal from the minimum flow rate command section 114. The second subtraction section 112 adds the required pump flow rate signal 103A and the minimum flow rate signal to compute the required pump flow rate signal 120 inputted from a machine controller 200. The second subtraction section 112 computes a deviation between the required pump flow rate signal 120 and the target assist flow rate signal 109A as a target pump flow rate signal 112A and outputs the target pump flow rate signal 112A to the second output conversion section 113.

The second output conversion section 113 converts the inputted target pump flow rate signal 112A into, for example, the displacement of the hydraulic pump 10 and outputs a control pressure command signal 210A to the solenoid proportional valve 74 such that a control pressure based on the displacement is attained. The solenoid proportional valve 74 reduces the pressure outputted from the high pressure selection valve 72 to attain the control pressure based on the command from the controller 100, and outputs the control pressure to the regulator 10A. The regulator 10A controls the displacement of the hydraulic pump 10 according to the inputted control pressure.

With the hydraulic excavator 1 according to the present embodiment described above, the auxiliary hydraulic pump 15 mechanically coupled to the regeneration hydraulic motor 13 can be directly driven by regeneration energy. This eliminates losses that result from temporary energy storage. This, as a result, makes it possible to reduce energy conversion losses, leading to efficient use of energy.

Further, a greater one of the required revolution speed of the regeneration hydraulic motor 13 and the required revolution speed of the auxiliary hydraulic pump 15 is selected as the target revolution speed of the electric motor 14. This configuration can prevent a drag loss of the regeneration hydraulic motor 13 and the auxiliary hydraulic pump 15 from increasing due to excessive revolution speed of the electric motor 14 and prevent the regeneration efficiency of the regeneration hydraulic motor 13 from decreasing due to insufficient revolution speed of the electric motor 14.

Although the embodiment of the present invention has been described in detail hereinabove, the present invention is not limited to the embodiment described above but includes various modifications. For example, the embodiment has been described in detail to describe the present invention in a comprehensible manner, and is not necessarily limited to the one including all the configurations that have been described.

DESCRIPTION OF REFERENCE CHARACTERS

1: Hydraulic excavator
1*a*: Boom
3*a*: Boom cylinder (first hydraulic actuator)
3*a*1: Bottom-side hydraulic chamber
3*a*2: Rod-side hydraulic chamber
3*b*: Arm cylinder (second hydraulic actuator)
3*c*: Bucket cylinder (second hydraulic actuator)
3*d*: Swing motor (second hydraulic actuator)
4: Operation device (first operation device)
4A: Pilot valve
5: Control valve
6: Check valve
7: Selector valve
8: Solenoid selector valve
9A: Inverter
9B: Chopper
9C: Electric storage device
10: Hydraulic pump (second hydraulic pump)
10A: Regulator
11: Pilot hydraulic pump
12: Tank
13: Regeneration hydraulic motor
14: Electric motor
15: Auxiliary hydraulic pump (first hydraulic pump)
15A: Regulator
16: Bleed valve
17: Solenoid proportional pressure reducing valve
24: Operation device (second operation device)
24A: Pilot valve
25: Chopper
30: Hydraulic line
31: Auxiliary hydraulic line (junction line)
32: Bottom-side hydraulic line
33: Regeneration circuit
34: Discharge hydraulic line
40: Pressure sensor (second pressure sensor)
41: Pressure sensor (first operation amount sensor)
42: Pressure sensor (second operation amount sensor)
43: Pressure sensor (second operation amount sensor)
44: Pressure sensor (first pressure sensor)
50: Engine
70: Power regeneration device
71: High pressure selection valve
72: High pressure selection valve
73: High pressure selection valve
74: Solenoid proportional valve
75: Pressure sensor
76: Revolution speed sensor
77: Pressure sensor
100: Controller
101: First function generation section
102: Second function generation section
102A: Target bottom flow rate signal
103: First subtraction section
103A: Required pump flow rate signal
104: First multiplication section
104A: Regeneration power signal
105: Second multiplication section
105A: Required pump power signal
106: First output conversion section
107: Third function generation section
108: Minimum value selection section
108A: Target assist power signal
109: First division section
109A: Target assist flow rate signal
111: Fourth function generation section
112: Second subtraction section
112A: Target pump flow rate signal
113: Second output conversion section
114: Minimum flow rate command section
120: Required pump flow rate signal
121: Second division section
122: Third division section
123: Maximum value selection section
124: Fourth division section
125: Fifth division section
126: Third output conversion section
127: Fourth output conversion section
128: Fifth output conversion section
141: Lever operation signal
142: Lever operation signal
143: Lever operation signal
145: Function generation section
146: Function generation section
147: Function generation section
148: Function generation section
149: Addition section
150: Addition section
151: Addition section
152: Function generation section
175: Lever operation signal

208: Solenoid valve command signal

210A: Control pressure command signal

The invention claimed is:

1. A work machine comprising:

a first hydraulic actuator;

a second hydraulic actuator;

a regeneration hydraulic motor that is driven by a return hydraulic fluid discharged from the first hydraulic actuator;

a first hydraulic pump mechanically coupled to the regeneration hydraulic motor;

an electric motor mechanically coupled to the regeneration hydraulic motor;

a second hydraulic pump that delivers a hydraulic fluid for driving the first hydraulic actuator or the second hydraulic actuator;

a junction line that allows a hydraulic fluid delivered by the first hydraulic pump to join a hydraulic fluid delivered by the second hydraulic pump;

a first operation device that directs an operation of the first hydraulic actuator;

a first operation amount sensor that detects an operation amount of the first operation device;

a second operation device that directs an operation of the second hydraulic actuator;

a second operation amount sensor that detects an operation amount of the second operation device;

a first pressure sensor that detects a pressure in the first hydraulic actuator;

a second pressure sensor that detects a pressure of the second hydraulic pump; and a controller configured to receive signals of the first operation amount sensor, the second operation amount sensor, the first pressure sensor, and the second pressure sensor and output a control command to the electric motor, the controller being configured to: compute a regeneration flow rate and a regeneration power of the regeneration hydraulic motor from the operation amount of the first operation device and the pressure in the first hydraulic actuator; compute a pump power of the second hydraulic pump from the operation amount of the second operation device and the pressure of the second hydraulic pump and set a smaller one of the regeneration power and the pump power as an assist power of the first hydraulic pump; and compute a target assist flow rate from the assist power and the pressure of the second hydraulic pump, wherein the controller is configured to:

compute a required regeneration hydraulic motor revolution speed from a regeneration hydraulic motor displacement and the regeneration flow rate, the required regeneration hydraulic motor revolution speed being a required revolution speed of the regeneration hydraulic motor, the regeneration hydraulic motor displacement being a displacement of the regeneration hydraulic motor;

compute a required first hydraulic pump revolution speed from a first hydraulic pump displacement and the target assist flow rate, the required first hydraulic pump revolution speed being a required revolution speed of the first hydraulic pump, the first hydraulic pump displacement being a displacement of the first hydraulic pump; and select a greater one of the required regeneration hydraulic motor revolution speed and the required first hydraulic pump revolution speed as a target electric motor revolution speed, the target electric motor revolution speed being a target revolution speed of the electric motor.

2. The work machine according to claim 1, wherein the regeneration hydraulic motor is a variable displacement hydraulic motor, and the controller is configured to control the regeneration hydraulic motor displacement according to the pressure in the first hydraulic actuator.

3. The work machine according to claim 1, wherein the first hydraulic pump is a variable displacement hydraulic pump, and the controller is configured to control the first hydraulic pump displacement according to the pressure of the second hydraulic pump.

4. The work machine according to claim 1, wherein the regeneration hydraulic motor is a variable displacement hydraulic motor, and the controller is configured to control the regeneration hydraulic motor displacement according to the target electric motor revolution speed and the regeneration flow rate.

5. The work machine according to claim 1, wherein the first hydraulic pump is a variable displacement hydraulic pump, and the controller is configured to control the first hydraulic pump displacement according to the target electric motor revolution speed and the target assist flow rate.

* * * * *